United States Patent [19]

Ohashi et al.

[11] Patent Number: 4,527,023

[45] Date of Patent: Jul. 2, 1985

[54] SMALL-SIZED ROTARY SWITCH

[75] Inventors: Shigeo Ohashi; Yoshiharu Kawashima, both of Tokyo, Japan

[73] Assignee: Nihon Kaiheiki Kogyo Kabushiki Kaisha, Tokyo, Japan

[21] Appl. No.: 567,381

[22] Filed: Dec. 30, 1983

[30] Foreign Application Priority Data

Jan. 16, 1983 [JP] Japan ..... 58-4026[U]

[51] Int. Cl.[3] ..... H01H 21/76

[52] U.S. Cl. ..... 200/11 G; 200/11 K

[58] Field of Search ..... 200/11 R, 11 A, 11 C, 200/11 D, 11 DA, 11 E, 11 G, 11 H, 11 J, 11 K, 11TW, 291, 11

[56] References Cited

U.S. PATENT DOCUMENTS

| | | | |
|---|---|---|---|
| 2,814,679 | 11/1957 | Leff et al. | 200/11 E |
| 2,980,770 | 4/1961 | Nabstedt | 200/11 A |
| 3,225,148 | 12/1965 | Sorenson | 200/11 E |
| 3,260,805 | 7/1966 | Pihl | 200/11 G |
| 3,261,930 | 7/1966 | Sorenson | 200/11 G |
| 3,303,296 | 2/1967 | Scott | 200/11 G |
| 3,311,718 | 3/1967 | Allison et al. | 200/11 K |
| 3,346,708 | 10/1967 | Morra | 200/11 G |
| 3,676,617 | 7/1972 | Miller | 200/11 G X |
| 3,903,383 | 9/1975 | Marker | 200/11 TW |
| 4,392,030 | 7/1983 | Buss | 200/11 R |

*Primary Examiner*—J. R. Scott

*Attorney, Agent, or Firm*—Birch, Stewart, Kolasch & Birch

[57] ABSTRACT

A small-sized rotary switch which comprises a switch base plate, fixed contacts formed on the base plate, a movable contact selectively engageable with one of the fixed contacts, a converter for holding the movable contact, a rotary shaft for rotating the converter, a cap adapted to accommodate all of the above-mentioned members therein and provided at the upper portion thereof with an aperture through which the rotary shaft extends, a stopper plate attached to the rotary shaft and disposed on the upper portion of the cap, the stopper plate being provided with an ear piece, and a variable stopper attached to the upper portion of the cap, with the stopper plate intervening therebetween, with an engagement projection being formed on either one of the cap and the variable stopper to engage the ear piece of the stopper plate.

9 Claims, 11 Drawing Figures

FIG. 9(a)
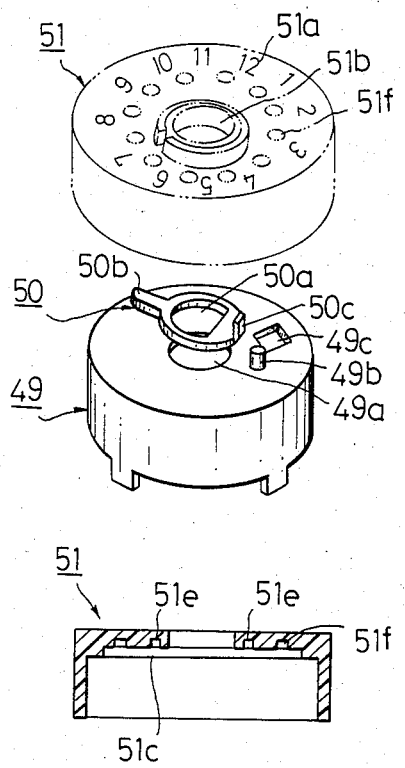
FIG. 10
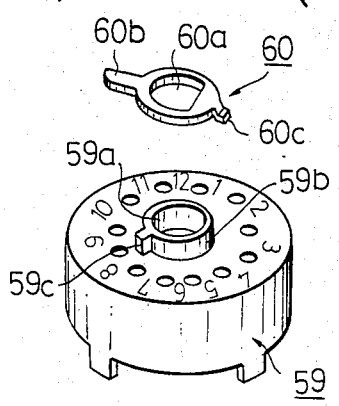
FIG. 9(b)

SMALL-SIZED ROTARY SWITCH

BACKGROUND OF THE INVENTION

This invention generally relates to a small-sized rotary switch. More particularly, the present invention relates to improvements in a stopper mechanism of a small-sized rotary switch.

Conventionally, a stopper mechanism is constructed, as shown in FIG. 1, in the following manner. A mounting screw 1 is provided on a cap 2 which is provided at its top portion with a plurality of apertures 2*a*. A pawl formed stopper 3 provided at its center with an opening 3*a* is fitted onto the mounting screw 1 of the cap 2 so that the pawl 3*b* is selectively inserted into one of the apertures 2*a* of the cap 2. The stopper 3 is then fixed to the cap 2 by tightening nuts 4 onto the screw 1. In the aforementioned construction, when a projection 5*a*, provided on a rotary shaft 5, engages with the pawl 3*b* of the stopper, the rotary shaft 5 is stopped.

Although there is no particular problem in the mechanical strength of the mechanism thus described, the problem in recent years of damage due to the environment arises from the miniaturization of switches. Namely, because of the presence of apertures 2*a* provided on the top portion of the cap 2 for insertion the pawl 3*b* of the stopper 3, the problem arises in that sulfide gas promoting oxidization of the electrical contacts or dust in the air intrudes into the cap through the apertures and causes an obstacle to the engagement between the contacts.

Furthermore, in recent years, small-sized switches tend to be used particularly in such a manner that the terminals of the switches are directly welded onto a printed circuit board. In such a case, there is a so-called washing step during which flux produced in welding is washed away after the small-sized switches are welded in an automatic welding vessel. At that time, in the conventional construction of switches, washing liquid flows onto the switch body through the apertures 2*a* of the cap, and therefore there is the possibility and thus disadvantage that the flux will not be washed out by a normal washing device. Consequently, the washing must be carefully controlled by using a brush for each switch, which is quite troublesome.

SUMMARY OF THE INVENTION

Therefore, it is an object of the present invention to provide a novel rotary switch which can eliminate the aforementioned disadvantages by providing a rotary stopper mechanism on the cap which eliminates the conventional apertures from the cap thereby sealing the switch.

It is another object of the invention to provide a novel small-sized rotary switch in which it is easier to alter the number of contacts of the switch, if necessary, thereby merely requiring one kind of switch.

In order to accomplish the foregoing, there is provided a small-sized rotary switch which comprises a switch base plate, fixed contacts formed on the base plate, a movable contact selectively engageable with one of said fixed contacts, a converter for holding the movable contact, a rotary shaft for rotating the converter, a cap adapted to accommodate all of the above-mentioned members therein and provided at the upper portion thereof with an aperture through which the rotary shaft extends, a stopper plate attached to the rotary shaft and disposed on the upper portion of the cap, the stopper plate being provided with an ear piece, and a variable stopper attached to the upper portion of the cap, with the stopper plate intervening therebetween, with an engagement projection being formed on either one of the cap and the variable stopper to engage the ear piece of the stopper plate.

BRIEF DISCRIPTION OF THE DRAWINGS

The present invention will now be described in detail by reference to embodiments illustrated in the accompanying drawings in which;

FIG. 1 is an exploded perspective view showing a main portion of a switch of a conventional type, FIG. 2 is an exploded perspective view showing an embodiment of a main portion of a small-sized rotary switch according to the present invention, FIG. 3 is a centrally cross-sectional view of the embodiment shown in FIG. 2, FIG. 4 is a top plan view showing the embodiment shown in FIG. 2 without the variable stopper, FIG. 5 is a cross-sectional view showing the variable stopper in the embodiment shown in FIG. 2, FIG. 6 is a cross-sectional view showing the stopper plate in the embodiment shown in FIG. 2, FIG. 7 is a perspective view showing another embodiment of a main portion of the present invention, FIG. 8 is a perspective view showing still another embodiment of a main portion of the invention, FIG. 9*a* is a view showing still another embodiment of a main portion of the present invention, FIG. 9*b* is a centrally cross-sectional view showing the variable stopper in the embodiment shown in FIG. 9*b*, and FIG. 10 is a perspective view showing still another embodiment of a main portion of the invention.

DETAILED DESCRIPTION

Figure 1:
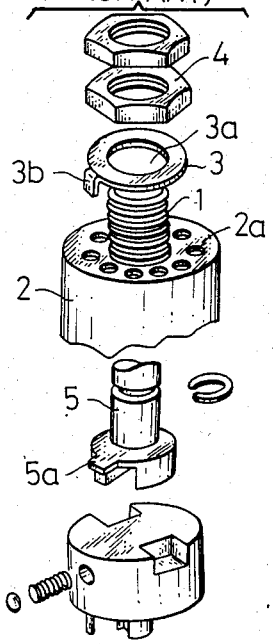
FIG. 1 (PRIOR ART)

Preferred embodiments of the present invention will be now described in detail with reference to the accompanying drawings.

In FIGS. 2 through 6, showing one embodiment of the present invention, a switch base plate 11 is formed with a concave-convex or corrugated portion 11*a* functioning to provide a changeover action by moving ball 12 thereon under the pressure of a resilient piece 13, a plurality of fixed contact pieces 11*b* and a common contact piece 11*c*. Each of the fixed contact pieces 11*b* extend downwardly through the base plate 11 to form an electric terminal 11*b*′ at its end. A reference numeral 11*d* indicates a cut-out portion for fixing a hereinafter described cap to the base plate. The switch further includes a movable contact piece 14, a converter 15 for holding and moving the movable contact piece, a rotary shaft 16, and rubber rings 17 and 18, respectively. There is provided a cut-out portion 15*a* in which the ball 12 is positioned, a recess 15*b* in which the lower portion 16*a* of the rotary shaft 16 is fitted, a recess 15*c* in which the leg portion 13*a* of the resilient piece 13 is fitted, and a cut-out 16*b*, respectively.

A cap 19 which is one of main members according to the present invention, is cylindrically formed and is engraved at its upper peripheral surface with FIGS. 19*a* (Numerals 1–12) indicating the number of contacts. The cap 19 is provided at its upper central portion with an aperture 19*b* through which the rotary shaft 16 extends. An area of the upper surface of the cap 19 inside the area engraved with the FIGS. 19*a* and around the aperture 19*b* is slightly lower than the upper peripheral surface of the cap to form a recess 19*c*. The recess 19*c* is concentrically formed centrally about the aperture with a medially placed groove 19*e* having a stopper 19*d* and at its outer side portion with a plurality of holes 19*f* corresponding to the FIGS. 19*a*. The stopper 19*d* may be a projection.

In assembling, after the sub-assembly comprising the ball 12, the resilient piece 13, the movable contact 14, the converter 15, the rotary shaft 16, and the rubber rings 17 and 18 is disposed on the base plate 11, the cap 19 is superimposed on the sub-assembly and both members are connected by engaging a pawl piece 19*g* of the cap 19 with the cut-out 11*d* of the base plate.

A stopper plate 20 which is one of the main members according to the present invention, is disposed within the recess 19*c* of the cap 19 and comprises an aperture 20*a* which is fitted onto and fixed to the rotary shaft 16, an ear piece 20*b* which is engaged by a projection 21*b* of a variable stopper 21, hereinafter described in detail, and a pawl piece 20*c* which moves along the groove 19*e* of the cap 19.

A variable stopper 24 which is still another of the main members according to the present invention, is constructed in the form of a circular cap. The variable stopper 21 has formed at the center of its upper surface an aperture 21*a* through which the rotary shaft 16 extends and is provided in the upper surface with an engagement projection 21*b* which engages with the ear piece 20*b* of the stopper plate to stop the rotation of the rotary shaft 16. If the engagement projection 21*b* is constructed so that its leading end is adapted to selectively fit into one of the holes 19*f* formed in the recess portion 19*c* of the cap 19, the variable stopper 21 can be easily fixed to the cap 19. However, the present invention is not limited to such a construction. The variable stopper 21 has also formed in the surface corresponding to the figures 19*a*, a window 21*c* through which the figures 19*a* are visible and one may be selected. However, in case where the variable stopper is made of a transparent material, the window may be eliminated.

Figure 7:
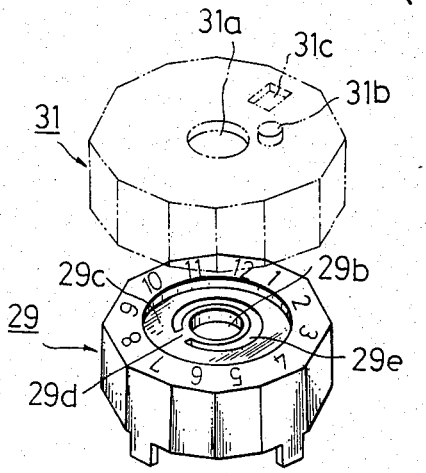
Figure 5:
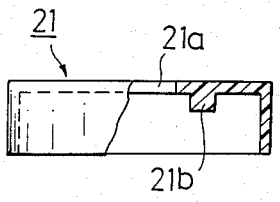

In FIG. 7, which is a perspective view showing another embodiment of a main portion according to the present invention, a cap 29 is formed as a polygon having apexes, the number of which corresponds to that of the electrical contacts. The cap 29 is provided at its center portion with an aperture 29*b* through which the rotary shaft 16 (see FIG. 2) rotatably extends and has concentrically formed a recess 29*c* around the aperture 29*b* with a groove 29*e* having a stopper 29*d*. A variable stopper 31 is superimposed on the cap 29, having a stopper plate, not shown, intervening therebetween, which is identical to the stopper plate 20 shown in FIG. 2. The variable stopper 31 is formed as a polygon having a inner surface of the side portion corresponding to the circumferential surface of the cap 29 and is provided at its center with an aperture 31*a* through which the rotary shaft 16 rotatably extends. The variable stopper 31 is provided on the inner surface of the upper portion with an engagement projection 31*b* which will engage with the ear piece of the stopper plate identical to that of the stopper plate 20 shown in FIG. 2. The variable stopper 31 is also provided in the upper surface with a window 31*c*. Furthermore, the engagement projection 31*b* is adapted to be located so as to project into the recess 29*c* of the cap 29 lateral to the groove 29*e*.

Figure 8:
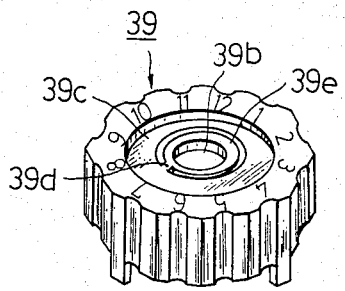
Figure 6:
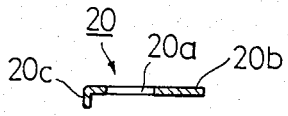

FIG. 8 is a perspective view showing still another embodiment according to the present invention. In FIG. 8, a cap 39 is provided at its side surface with recesses. The number of recesses which correspond to the number of contacts in this instance, is twelve the cap has a center portion an aperture 39*b* through which the rotary shaft 16 shown in FIG. 2 extends. The recess 39*c* is concentrically formed in its surface with a groove 39*e* having a stopper 39*d*. Although, in this embodiment, a variable stopper is not shown, the variable stopper used herewith will be provided with a side portion an inner surface provided with a plurality of projections corresponding to the recesses provided on the circumferential surface of the cap 39. The inner surface of the upper portion of the variable stopper has a profile similar to that of the variable stopper 31 shown in FIG. 7.

Figure 2:
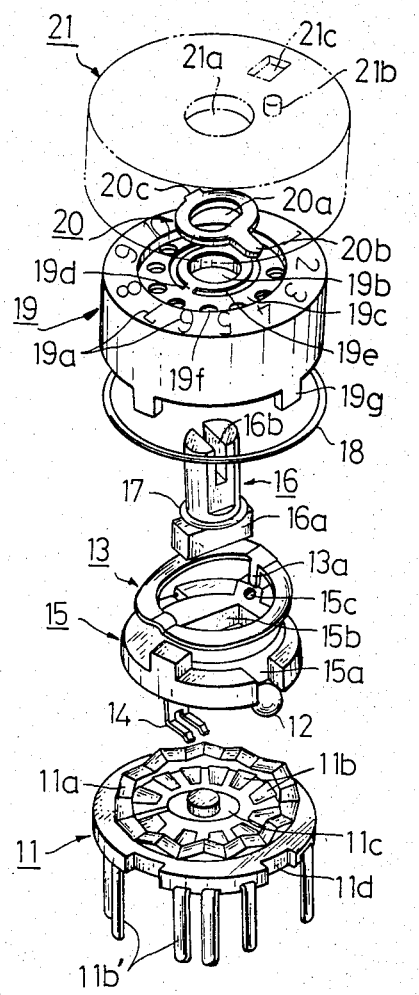
Figure 3:
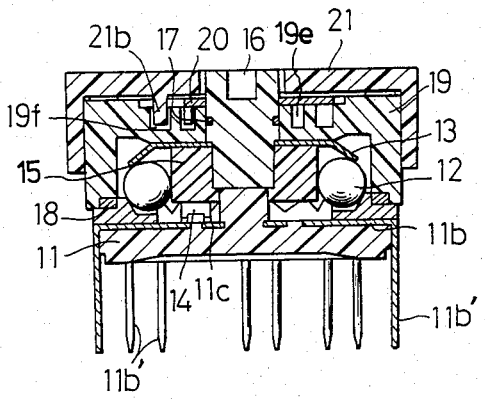
Figure 4:
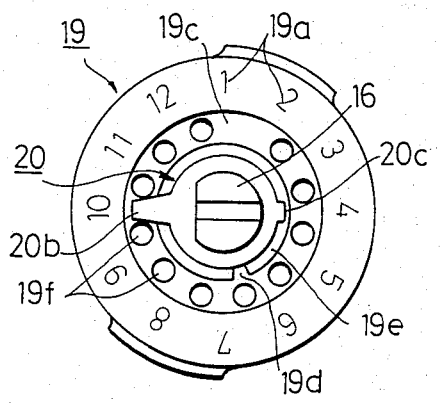

In the constructions of the embodiments illustrated in FIGS. 7 and 8, it is not necessary to provided each cap with holes 19*f* as in the embodiment illustrated in FIG. 2.

FIGS. 9*a* and 9*b* show another embodiment according to the present invention. FIG. 9*a* is a perspective view showing a cap, a stopper plate, and a variable stopper and FIG. 9*b* is a cross-sectional view of the variable stopper. In the present embodiment, the constructional elements comprising the cap and variable stopper are reversed with those elements of the embodiment illustrated in FIGS. 2 through 6. A cap 49 is formed with an aperture 49*a* through which the rotary shaft 16 (see FIG. 2) extends and is provided at its upper portion with projection 49*b* and a window 49*c*. The stopper plate 50 which is disposed on the cap 49 is formed with an aperture 50*a* through which the rotary shaft 16 extends, an ear piece 50*b* which engages the projection 49*b*, and a pawl piece 50*c* which engages a groove 51*e* of the variable stopper 51. The variable stopper 51, which is placed on the cap 49 and the stopper plate 50, is formed on the upper surface of a top portion with figures 51*a* corresponding to the number of contacts and at its center with an aperture 51*b* through which the rotary shaft 16 extends. The variable stopper 51 is further formed on the inner surface of its top portion with a recess 51*c* in which the stopper plate 50 is disposed, a circular groove 51*e* having a stopper, and holes 51*f* one of which is selectively engaged by the projection 49*b* of the cap 49 to serve to stop the movement of the ear piece 50*b* of the stopper plate at the number which corresponds to the number of contacts, respectively.

FIG. 10 shows still another embodiment according to the present invention. In the embodiment, a cap 59 is formed around its aperture 59*a* with a projection 59*b*, a portion of which forms an engagement member 59*c*. The pawl piece 60*c* of a stopper plate 60 is engageable with the engagement member 59*c*. Apertures 59*a* and 60*a* are provided through which the rotary shaft 16 (see FIG. 2) extends along with ear piece 60*b*.

Referring now to FIGS. 2 through 6 once again, in the illustrations, as an alternative to the construction of the variable stopper 21, the variable stopper may be constructed in the form of a disc rather than circular-shaped cap and may be attached to the upper portion of the cap 19 as by a screw. In such a case, the variable stopper is provided with apertures, the number of which corresponds to the number of the holes 19*f* of the cap 19. By inserting screws through one or more selected apertures into one or more holes, the variable stopper is located in a fixed position relative to the cap 19.

In the aformentioned contruction according to the present invention, although twelve contacts are shown to be included in a circuit, by changing the position in which the variable stopper is disposed on the cap 19, that is, by selecting one of the positions indicated by the figures 19*a* of the cap 19 through the engagement projection 21*b*, the range of rotation of the rotary shaft 16 can be limited thereby optionally setting, for example, four contacts or six contacts in a circuit. Furthermore, the number of contacts are displayed in the window 21*c*. Consequently, while monitoring the figures displayed on the window 21*c*, a desired number of contacts can be set and fixed by movement of the variable stopper 21.

In the embodiment, although the stopper plate 20 is formed with the pawl piece 20*c* which slidably moves in the groove 19*e* of the cap 19, and the stopper 19*d* is engaged by the pawl piece 20*c* to stop the same thereby constituting one of the stop points of the rotary shaft 16, the stopper 19*d* and the groove 19*e* may be eliminated and instead a projection, not shown, provided in place of the stopper 19*d* adapted to be engaged by a Z-shaped stopper, now shown, formed on the pawl 20*c* of the stopper plate 20 or the ear piece 20*b*.

The present invention constructed as mentioned above has the following advantages:

Since it is not necessary to provide apertures for the variable stopper on a cap, a sealed type switch can be obtained. Consequently, the configuration can prevent sulfide gas or dust from intruding into the interior of the switch and at the same time, a normal washing device can be used to wash out flux produced in the welding of terminals and thereby prevent the intrusion of washing liquid into the interior of the switch from occuring.

In a conventional rotary switch having a mounting screw, because the stopper plate is provided within the cap as shown in FIG. 1, the ear piece of the stopper must be seen through the apertures of the cap from the outside of the switch to know where the ear piece of the stopper is located, which is very difficult.

However, the stopper plate is disposed on the cap, where the location of the movable ear piece of the stopper plate can be recognized at a glance, and therefore the setting of the stopper by the variable stopper is easily made thereby avoiding error in setting of the stopper.

Furthermore, in case of a conventional rotary switch having no bushings or switch mounting screws, it is impossible to change the position of the stopper from the outside of the switch. Consequently, several kinds of switches of exclusive use such as three-contact switches, four-contact switches or six-contact switches, must be prepared in assembling switches. However, according to the present invention, even for a rotary switch having no bushings, only one kind of switch may be prepared and can be easily changed to have a specific number of contacts, if necessary.

Furthermore, as a result of the figures indicating the number of contacts being engraved on the upper surface of the cap, and the window being provided on the variable or movable stopper through which one can selectively set out these figures, the setting of the stopper is easily made and at the same time the number of contacts of the switch can be recognized at a glance by the figure located on the window.

In the case where the switch cap is formed to be cylindrical and the variable stopper is formed to be of a circular cap, the variable stopper is fitted onto and fixed to the cap in any desired position, and therefore the setting of the stopper is very easily made.

Although the present invention has been described with reference to certain preferred embodiments thereof, the embodiments are intended to be merely illustrative but in no way restrictive. Hence, various changes and modifications could be made by those skilled in the art without departing from the scope of the present invention.

What is claimed is:

1. A small-sized rotary switch which comprises a base plate, fixed contacts provided about a peripheral edge of said base plate, a movable contact slidable on said fixed contacts which can selectively engage one of said fixed contacts, a common contact provided on a center portion of said base plate to be engaged by a portion of said movable contact, a converter slidably disposed on said base plate and comprising said movable contact, a rotary shaft rigidly connected to said converter for rotating said converter, a cap having a center aperture which passes through a upper portion adapted to fit onto said base plate about said rotary shaft passing through said center aperture so as to accommodate and provide a seal for said fixed contacts, said movable contact, said common contact and said converter, a stopper plate connected to said rotary shaft for rotation with said rotary shaft, slidably disposed on said cap, said stopper plate being provided with an ear piece, and a variable stopper made to fit over and compliment said cap so as to selectively fit onto said cap such that a number of said fixed contacts engaged with said movable contact can be selected, said stopper plate intervening between said variable stopper and said cap, with either one of said cap and said variable stopper being provided with an engagement member to engage said ear piece of said stopper plate.

2. A switch as set forth in claim 1, wherein said cap is provided at said upper portion about said aperture with a concentric recess having a medially positioned concentric groove with a stopper juxtapositioned to said rotary shaft, said stopper plate being provided with a pawl piece, said pawl piece moving along said groove.

3. A switch as set forth in claim 2, wherein said cap is further provided at said upper portion thereof with a plurality of concentric holes around said rotary shaft lateral to said concentric groove within said recess, and that said engagement member of said variable stopper may be selectively fitted into one of said holes to locate said variable stopper in a position relative to said cap.

4. A switch as set forth in claim 3, wherein said cap is constructed to be a polygon and said variable stopper is formed to be polygonal so as to compliment said cap.

5. A switch as set forth in claim 3, wherein said cap is formed at the circumferential surface thereof with a plurality of recesses and said variable stopper is formed at the inner surface thereof with a plurality of projections which are engageable with said recesses of said cap.

6. A switch as set forth in claim 1, wherein said cap is formed to be cylindrical, and said variable stopper is provided in the inner surface of the upper portion thereof with a concentric groove around said rotary shaft, said stopper plate is provided with a pawl piece, said pawl piece moving along said groove, said cap being provided at the upper portion thereof with a projection which constitutes said engagement member.

7. A switch as set forth in claim 1, wherein said cap is formed to be cylindrical and is provided at the upper portion thereof with a projection with a stopper, said projection constituting said engagement member, and said variable stopper is provided at the inner surface of the upper portion thereof with a concentric groove around said rotary shaft, said stopper plate being provided with a pawl piece, said pawl piece moving along said groove.

8. A switch as set forth in claim 3, wherein said cap is formed to be cylindrical and said variable stopper is formed similarly cylindrical to compliment said cap.

9. A switch as set forth in claim 1, wherein a window is provided in at least one of said variable stopper and said cap.

* * * * *